United States Patent [19]

Weigel

[11] Patent Number: 5,026,633

[45] Date of Patent: Jun. 25, 1991

[54] COLOR PHOTOTHERMOGRAPHIC MATERIALS WITH DEVELOPMENT ACCELERATOR

[75] Inventor: David C. Weigel, St. Paul, Minn.

[73] Assignee: Minnesota Mining and Manufacturing Company, St. Paul, Minn.

[21] Appl. No.: 386,294

[22] Filed: Jul. 27, 1989

[51] Int. Cl.[5] ..... G03C 1/10

[52] U.S. Cl. ..... 430/551; 430/523; 430/531; 430/559; 430/618; 430/619; 430/620

[58] Field of Search ..... 430/542, 551, 559, 618, 430/619, 620, 523, 531, 469, 487, 480, 483

[56] References Cited

U.S. PATENT DOCUMENTS

| | | | |
|---|---|---|---|
| 4,452,883 | 6/1984 | Frenchik et al. | 430/502 |
| 4,460,681 | 7/1984 | Frenchik | 430/502 |
| 4,476,220 | 10/1984 | Penfound | 430/569 |
| 4,640,892 | 2/1987 | Kawata et al. | 430/617 |
| 4,777,113 | 10/1988 | Inoue et al. | 430/523 |
| 4,782,010 | 11/1988 | Mader et al. | 430/538 |
| 4,792,514 | 12/1988 | Nakamura et al. | 430/617 |
| 4,795,697 | 1/1989 | Vogel et al. | 430/619 |
| 4,876,173 | 10/1989 | Maemoto et al. | 430/273 |
| 4,883,747 | 11/1989 | Grieve et al. | 430/542 |
| 4,889,788 | 12/1989 | Stahlhofen et al. | 430/270 |
| 4,902,599 | 2/1990 | Yamamoto et al. | 430/617 |
| 4,912,011 | 3/1990 | Yamamoto et al. | 430/617 |

OTHER PUBLICATIONS

U.S. patent application No. 07/200,665, filed May 31, 1989, entitled "Colour Photothermographic Elements".

*Primary Examiner*—Hoa Van Le

*Attorney, Agent, or Firm*—Gary L. Griswold; Walter N. Kirn; Mark A. Litman

[57] ABSTRACT

Photothermographic dry silver emulsions containing a benzylidene lenco dye and a development accelerator provide a high density yellow image upon exposure to actinic radiation and thermal developing at a relatively low temperature and for a short period of time.

6 Claims, No Drawings

COLOR PHOTOTHERMOGRAPHIC MATERIALS WITH DEVELOPMENT ACCELERATOR

TECHNICAL FIELD

The present invention relates to silver halide photothermographic color imaging materials and, in particular, to development accelerators for use therein.

BACKGROUND OF THE INVENTION

Silver halide photothermographic imaging materials, often referred to as "dry silver" compositions because no liquid development is necessary to produce the final image, have been known in the art for many years. These imaging materials typically comprise a light insensitive, reducible silver source material; a light sensitive material which generates silver when irradiated; and a reducing agent for the silver ion in the silver source material.

The silver source material is a material which contains silver ions. The earliest and generally preferred silver source materials comprise silver salts of long chain carboxylic acids, usually of from 10 to 30 carbon atoms. The silver salt of behenic acid or mixtures of acids of like molecular weight have primarily been used.

The light sensitive material is typically a photosensitive silver halide which is in catalytic proximity to the light insensitive silver source material. Catalytic proximity is an intimate physical association of these two materials so that when silver specks or nuclei are generated by the irradiation or light exposure of the photosensitive silver halide, those nuclei are able to catalyze the reduction of the silver source by the reducing agent.

In these photothermographic imaging materials, exposure of the silver halide to light produces small clusters of silver atoms. The imagewise distribution of these clusters is known in the art as the latent image. This latent image generally is not visible by ordinary means and the light sensitive article must be further processed in order to produce a visible image. The visible image is produced by the catalytic reduction of the silver ions of the silver source material which are in catalytic proximity to the silver specks of the latent image.

Color-forming, "dry silver" imaging systems are likewise well known in the photothermographic art. Color formation is typically based on the silver catalyzed oxidation/reduction reaction between the silver source material and the reducing agent. Typically, the reducing agent is a colorless or lightly colored leuco dye or dye forming developer that is oxidizable to a colored state.

Multicolor photothermographic imaging articles typically comprise two or more monocolor-forming emulsion layers (often each emulsion layer comprises a set of bilayers containing the color-forming reactants) maintained distinct from each other by barrier layers. The barrier layer overlaying one photosensitive, photothermographic emulsion layer typically is insoluble in the solvent of the next photosensitive, photothermographic emulsion layer. Photothermographic articles having at least 2 or 3 distinct color-forming emulsion layers are disclosed in U.S. Pat. Nos. 4,021,240 and 4,460,681.

Typically each of the color-forming photothermographic emulsion layers contains a reducible silver source material, a spectrally sensitized photosensitive silver halide, a reducing agent for silver ion and a solvent soluble binder. For example, U.S. Pat. Nos. 4,460,681 and 4,452,883 disclose multicolor photothermographic articles in which each photothermographic emulsion layer is sensitized to a portion of the spectrum at least 60 nm different from the other photothermographic emulsion layers, and each photothermographic emulsion layer contains a leuco dye which when oxidized forms a visible colored dye having a maximum absorbance at least 60 nm different from that of the dye formed in the other photothermographic emulsion layers. Usually one of the color forming photothermographic emulsion layers forms a yellow color. Although such multicolor photothermographic imaging materials are well known in the art, in recent times considerable effort is being expended to increase the stability of the emulsions and decrease the time and temperature required for thermal development. However, such efforts have often encountered the traditional problem of balancing the development rate of the emulsion with the shelf-stability of the photothermographic article. The more rapidly the image may be developed in the emulsion during thermal development, the greater the tendency the emulsion has to form dyes without exposure and heating. As a result, conventional methods of speeding up the rate of color formation, such as by using fast coupling color couplers or easily oxidizable leuco dyes in the photothermographic system, consistently tend to increase the formation of spurious dye images (i.e., background coloration or fog).

As a solution to this problem, compounds are continually being sought which decrease the time and temperature required for development of the photothermographic emulsion without lessening the stability of the photothermographic article or the quality of the image produced. In this respect U.S. Pat. Nos. 4,626,500; 4,629,684; and 4,640,892 disclose development accelerator compounds for use with photothermographic emulsions containing a silver halide, a leuco dye and an organic silver salt oxidizing agent. Purportedly these compounds provide a heat developable color photographic light sensitive material which provides an image having a high maximum density and a low fog by heat developing at a relatively low temperature and for a relatively short time.

The time and temperature required for the thermal development of multicolor photothermographic articles are typically determined by the time and temperature required to develop the color-forming emulsion layer having the slowest development rate. In multicolor photothermographic articles having a yellow-forming emulsion layer, it is generally the yellow forming emulsion layer which requires the longest development time and/or the highest development temperature to achieve sufficient image density. It is toward the end of reducing the time and/or temperature required to thermally develop a yellow-forming emulsion layer that the present invention pertains.

SUMMARY OF THE INVENTION

The present invention provides a photothermographic emulsion capable of producing a high density yellow image upon exposure to actinic radiation and thermal developing at a relatively low temperature and for a short period of time. The photothermographic emulsion of the invention comprises: (a) a binder; (b) a silver salt of an organic acid; (c) a light sensitive silver halide in catalytic proximity to the silver salt; (d) a benzylidene leuco dye which is oxidizable by silver ions into a yellow dye of the general formula:

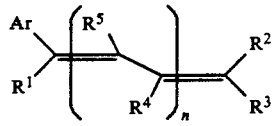

in which:

n=0, 1 or 2, $R^1$ represents H, CN, lower alkyl of 1 to 5 carbon atoms, aryl or $COOR^6$ in which $R^6$ is lower alkyl of 1 to 5 carbon atoms or aryl, $R^2$ and $R^3$ independently represent CN, $NO_2$, $COOR^6$, $SO_2R^6$ and $CONHR^6$, in which $R^6$ is as defined above, or $R^2$ and $R^3$ together represent the necessary atoms to form a 5- or 6-membered carbocyclic or heterocyclic ring having ring atoms selected from C, N, O and S atoms, which carbocyclic or heterocyclic rings possess at least one conjugated electron withdrawing substituent, $R^4$ and $R^5$ independently represent H, CN or lower alkyl of 1 to 5 carbon atoms or together represent the necessary atoms to complete a 5- or 6-membered carbocyclic ring, and Ar represents a thienyl group, furyl group, or phenyl group, e.g.:

a) a thienyl group which may be substituted with one or more lower alkyl groups of 1 to 5 carbon atoms, b) a furyl group which may be substituted with one or more lower alkyl groups of 1 to 5 carbon atoms, or c) a phenyl group which may be substituted with one or more groups selected from halogen, hydroxy, lower alkyl of 1 to 5 carbon atoms, lower alkoxy of 1 to 5 carbon atoms, $NR^7R^8$ in which $R^7$ and $R^8$ are independently selected from H, lower alkyl group of 1 to 5 carbon atoms which may possess substituents selected from CN, OH, halogen, phenyl, and phenyl group substituted with substituents selected from OH, halogen, lower alkyl of 1 to 5 carbon atoms or lower alkoxy of 1 to 5 carbon atoms, or $R^7$ and $R^8$ together represent the necessary atoms to complete a morpholino group, or when Ar is a phenyl group, that phenyl group may be part of a larger ring structure comprising two or more rings which may be aromatic or heterocyclic containing up to 20 ring atoms selected from C, N, O and S; and (e) a development accelerator having the general formula:

$$(Ph)_3—X$$

in which:

Ph is phenyl, and

X is a nitrogen containing bridging group selected from the group consisting of N,

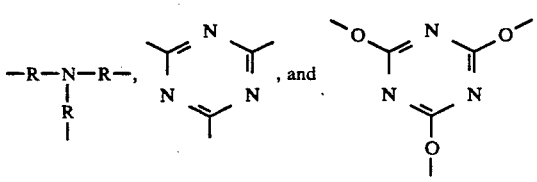

wherein R is independently selected from an alkyl group having up to 5 carbon atoms.

The photothermographic emulsion of the invention may be used to decrease the time and temperature required for the development of a yellow image of suitable density in single color or multicolor photothermographic articles. The reduction in development time and temperature being attributable to the inclusion in the photothermographic emulsion of a development accelerator selected from the narrow class of compounds listed above.

DETAILED DESCRIPTION OF THE INVENTION

The photothermographic emulsion layer of the invention may be constructed as a single layer or a set of bilayers on a substrate. In either construction a single layer must contain the silver source material, the silver halide in catalytic proximity to the silver source material, the reducing agent in reactive association with the silver source material, the development accelerator in catalytic proximity to both the reducing agent and the silver source material, and binder. Additionally, optional materials such as toners, coating aids and other adjuvants may be included in this layer. In the two-layer construction, the second layer preferably comprises a polyvinyl alcohol topcoat which may contain some of the optional materials described above.

The terms catalytic proximity and reactive association are well known in the art. Catalytic proximity means that the compound is in such physical proximity to the silver source material that it can act as a catalyst in the thermally activated reduction of the silver source material. Reactive association means that the color-forming reducing agent can reduce the silver source material.

The silver source material, as mentioned above, may be any material which contains a reducible source of silver ions. Silver salts of organic acids, particularly long chain (10 to 30, preferably 15 to 28 carbon atoms) fatty carboxylic acids are preferred. Complexes of organic or inorganic silver salts wherein the ligand has a gross stability constant between 4.0 and 10.0 are also desirable. The silver source material should constitute from about 20 to 70 percent by weight of the imaging layer. Preferably, it is present in an amount constituting from about 30 to 55 percent by weight of the imaging layer. The second layer in the two-layer construction does not affect the percentage of the silver source material desired in the single imaging layer.

The silver halide may be any photosensitive silver halide such as silver bromide, silver iodide, silver chloride, silver bromoiodide, silver chlorobromoiodide, silver chlorobromide, etc., and may be added to the emulsion layer in any fashion which places it in catalytic proximity to the silver source material. The silver halide is generally present in an amount constituting from about 0.75 to 15 percent by weight of the imaging layer, although larger amounts, up to 20 or 25 percent, are useful. It is preferred to use from 1 to 10 percent by weight silver halide in the imaging layer and most preferred to use from 1.5 to 7.0 percent.

The reducing agents useful in the present invention are the benzylidene leuco dyes oxidizable by silver ion into yellow dyes of the formula described above. Examples of suitable yellow dye forming benzylidene leuco dyes, and methods of synthesizing them, are described in U.S. Pat. application No. 200,665, filed on May 31, 1988 which is incorporated herein by reference. The preferred benzylidene leuco dyes useful in the invention are those of the formula:

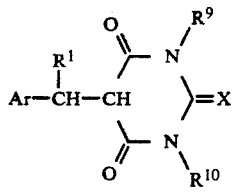

which, upon oxidation by silver ions, provide yellow dyes of the formula:

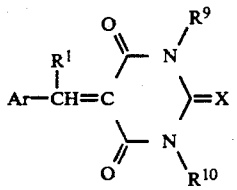

in which:

X is O or S, preferably O;

Ar and $R^1$ are as defined above; and $R^9$ and $R^{10}$ independently represent lower alkyl groups of 1 to 5 carbon atoms, aralkyl groups of up to 10 carbon atoms or a phenyl moiety.

Of these, the more preferred benzylidene leuco dyes are barbituric acid derivatives of the following formula:

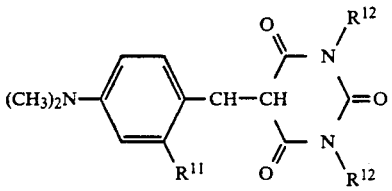

in which:

$R^{11}$ is H or a methyl moiety; and $R^{12}$ is selected from alkyl groups of up to 6 carbon atoms and cycloalkyl groups of up to 6 carbon atoms.

The most preferred benzylidene leuco dye is that in which $R^{11}$ is H and $R^{12}$ is a cyclohexyl moiety. The benzylidene leuco dye should be present in an amount constituting from about 1 to 10 percent by weight of the imaging layer.

As is well understood in this technical area, a large degree of substitution is not only tolerated but is often advisable. As a means of simplifying the discussion and recitation of these groups, the terms "group" and "moiety" are used to differentiate between chemical species that allow for substitution or which may be substituted. For example, the phrase "alkyl group" is intended to include not only pure hydrocarbon alkyl chains such as methyl, ethyl, octyl, cyclo-hexyl, isooctyl, tert-butyl and the like, but also such alkyl chains bearing such conventional substituents in the art such as hydroxyl, alkoxy, phenyl, halo (F, Cl, Br, I), cyano, nitro, amino, etc. The phase "alkyl moiety" on the other hand is limited to the inclusion of only pure hydrocarbon alkyl chains such as methyl, ethyl, propyl, cyclohexyl, isooctyl, tert-butyl, and the like.

Toner materials may also be present, for example, in amounts of from about 0.2 to 10 percent by weight of all of the silver bearing components. Toners are well known materials in the photothermographic art as shown by U.S. Pat. Nos. 3,080,254; 3,847,612 and 4,123,282.

The development accelerators useful in the present invention should be of sufficiently low volatility to remain in the emulsion layer during the drying operation. Preferably the development accelerators are solid at the temperatures used to dry the emulsions. The development accelerator is preferably present in an amount constituting from about 0.005 to 0.5 percent by weight of the imaging layer.

The binder may be selected from any of the well known natural and synthetic resins such as gelatin, polyvinyl acetyls, polyvinyl acetate, cellulose acetate, polyolefins, polyesters, polystyrene, polyacrylonitrile, polycarbonates and the like. Copolymers and terpolymers are of course included in these definitions. The polyvinyl acetyls such as polyvinyl butyral and polyvinyl formal, and vinyl copolymers such as polyvinyl acetate/chloride are particularly desirable. The binder is generally used in an amount constituting from about 20 to 75 percent by weight of the imaging layer, and preferably from about 30 to 55 percent by weight.

For use on paper or other non-transparent backings it is generally found convenient to use silver half-soaps, of which an equimolar blend of silver behenate and behenic acid, prepared by precipitation from the aqueous solution of the sodium salt of commercial behenic acid and analyzing about 14.5 percent silver, represents a preferred example. Transparent sheet materials made on transparent film backings require a transparent coating and for this purpose the silver behenate full soap, containing not more than about four or five percent of free behenic acid and analyzing about 25.2 percent silver, may be used. Other components such as opacifiers, extenders, spectral sensitizing dyes, etc., may be incorporated as required for various specific purposes. Antifoggants, such as mecuric salts, tetrachlorophthalic anhydride or tetrachlorophthalic acid, may also be included in the formulation.

EXAMPLES

A dispersion of a silver behenate half soap was made at 15 percent solids in toluene by homogenization. From this a standard dry silver photothermographic formulation was prepared comprising:

127 g half-soap silver behenate
267.5 g toluene
267.5 g methyl ethyl ketone
1 ml of a 10% solution of pyridine in acetone
6 ml of a solution of 3.6 g $HgBr_2$ in 100 ml methanol
6 ml of a solution of 2.6 g $CaBr_2$ in 100 ml methanol
68 g poly(vinyl butyral) commercially available from Monsanto Co. under the trade designation "Butvar B-76".

EXAMPLE 1

To 20 grams of the standard formulation described above was added:

0.1 g tribenzylamine
0.0002 g merocyanine spectral sensitizing dye
0.1 g a benzylidene leuco dye of the formula:

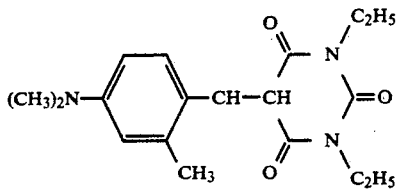

This mixture was then coated on a polyester substrate to a wet thickness of 3 mils (.076 mm) and dried at 180° F. (81° C.). Thereafter a top coat solution comprised of:

5 g polyvinyl alcohol commercially available from Air Products Inc. under the trade designation "Vinol 523"

50 g methanol 50 g water 0.4 g phthalazinone was coated to a wet thickness of 3 mils (.076 mm) over the first coating and dried at 180° F. (81° C.).

CONTROL EXAMPLE A

The photothermographic element of Control Example A was prepared as described above in Example 1 with the exception that there was no tribenzylamine present in the coating formulation.

EXAMPLE 2

To 20 g of the standard formulation described above was added:

0.12 g triphenylamine 0.0002 g merocyanine spectral sensitizing dye 0.125 g benzylidene leuco dye of the formula:

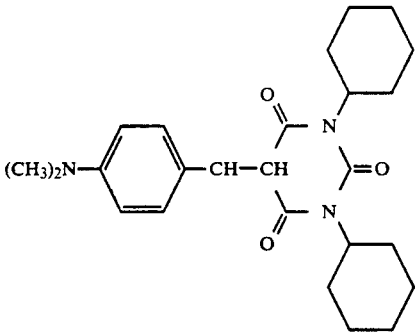

This mixture was then coated on a polyester substrate to a wet thickness of 3 mils (.076 mm) and dried at 180° F. (81° C.). Thereafter a topcoat solution comprised of:

5 g polyvinyl alcohol commercially available from Air Products Inc. under the trade designation "Vinol 523"

50 g methanol 50 g water 0.06 g tetrachlorophthalic acid 0.0025 g benzotriazole was coated to a wet thickness of 3 mils (.076 mm) over the first coating and dried at 180° F. (81° C.).

CONTROL EXAMPLE B

The photothermographic element of Control Example B was prepared as described above in Example 2 with the exception that there was no triphenylamine in the coating formulation.

EXAMPLE 3

To 20 g of the standard formulation described above was added:

0.5 g 2,4,6-triphenyl-s-triazine 0.0002 g merocyanine spectral sensitizing dye 0.12 g benzylidene leuco dye of the formula:

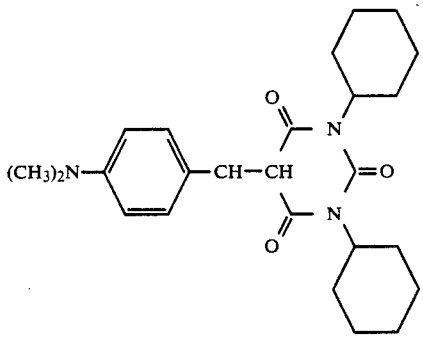

This mixture was then coated on a polyester substrate to a wet thickness of 3 mils (.076 mm) and dried at 180° F. (81° C.). Thereafter a topcoat comprised of:

5 g polyvinyl alcohol commercially available from Air Products Inc. under the trade designation "Vinol 523"

50 g methanol 50 g water 0.4 g phthalazinone was coated to a wet thickness of 3 mils (.076 mm) over the first coating and dried at 180° F. (81° C.).

CONTROL EXAMPLE C

The photothermographic element of Control Example C was prepared as described above in Example 3 with the exception that there was no 2,4,6-triphenyl-s-triazine in the coating formulation.

The photothermographic elements of Examples 1–3 and Control Examples A–C were exposed to white light on an EG&G flash sensitometer (commercially available from Edgerton Company) and developed on a hot roll processor for 6 seconds. The maximum image density ($D_{max}$) and the minimum image density ($D_{min}$) were then measured for each element with a MacBeth densitometer using a blue status A filter. The development temperature and the results of these measurements are shown below in Table 1 for each of the photothermographic elements tested.

TABLE 1

| | Example 1 (263° F.) | Control Example A (263° F.) | Example 1 (280° F.) | Control Example A (280° F.) | Example 2 (280° F.) | Control Example B (280° F.) | Example 3 (263° F.) | Control Example C (263° F.) | Example 3 (275° F.) | Control Example C (275° F.) |
|---|---|---|---|---|---|---|---|---|---|---|
| $D_{max}$ | 1.68 | 1.31 | 1.72 | 1.70 | 1.90 | 1.30 | 1.95 | 1.35 | 1.93 | 1.74 |
| $D_{min}$ | 0.17 | 0.17 | 0.17 | 0.16 | 0.11 | 0.11 | 0.13 | 0.13 | 0.10 | 0.10 |

The data in table 1 shows that the photothermographic element of each Example provided an image having a greater $D_{max}$ than the photothermographic element of the corresponding Control Example upon development at the same temperature and for the same period of time.

What is claimed is:

1. A photothermographic emulsion capable of producing an image having a visible yellow color upon exposure to actinic radiation and thermal development comprising:

(a) a binder;

(b) a silver salt of an organic acid;

(c) a light sensitive silver halide in catalytic proximity to said silver salt;

(d) a benzylidene leuco dye which is oxidizable by silver ions into a yellow dye of the general formula:

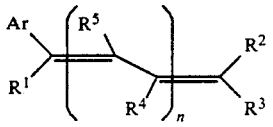

in which:

n=0, 1 or 2, $R^1$ represents H, CN, lower alkyl of 1 to 5 carbon atoms, aryl or $COOR^6$ in which $R^6$ is lower alkyl of 1 to 5 carbon atoms or aryl, $R^2$ and $R^3$ independently represent CN, $NO_2$, $COOR^6$, $SO_2R^6$, and $CONHR^6$, in which $R^6$ is as defined above, or $R^2$ and $R^3$ together represent the necessary atoms to form a 5-or 6-membered carbocyclic ring or heterocyclic ring having ring atoms selected from C, N, O and S atoms, which carbocyclic or heterocyclic rings possess at least one conjugated electron withdrawing substituent, $R^4$ and $R^5$ independently represent H, CN or lower alkyl of 1 to 5 carbon atoms or together represent the necessary atoms to complete a 5- or 6-membered carbocyclic ring, and Ar represents a thienyl group, a furyl group or a phenyl group; and (e) a development accelerator having the general formula:

$(Ph)_3—X$ in which:

Ph is phenyl, and

X is a nitrogen containing bridging group selected from the group consisting of

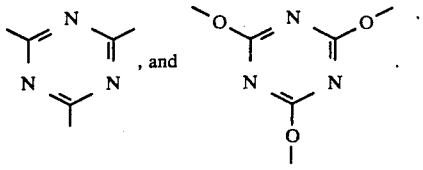

2. A photothermographic emulsion as recited in claim 1 wherein said benzylidene leuco dye is of the formula:

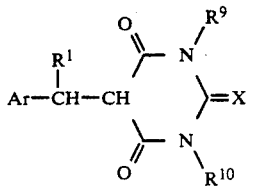

in which:

X is O or S;

$R^1$ represents H, CN, lower alkyl of 1 to 5 carbon atoms, aryl, or $COOR^6$ in which $R^6$ is lower alkyl of 1 to 5 carbon atoms or aryl;

Ar represents a thienyl group, a furyl group or a phenyl group; and $R^9$ and $R^{10}$ independently represent lower alkyl groups of 1 to 5 carbon atoms, aralkyl groups of up to 10 carbon atoms or a phenyl moiety.

3. A photothermographic element comprising the photothermographic emulsion of claim 1 on a substrate.

4. A photothermographic element comprising the photothermographic emulsion of claim 2 on a substrate.

5. A photothermographic emulsion capable of producing an image having a visible yellow color upon exposure to actinic radiation and thermal development comprising:

(a) a binder;

(b) silver behenate;

(c) silver halide selected from the group consisting of silver chloride, silver chlorobromide, silver chloroiodide, silver bromide, silver iodobromide, silver chloroiodobromide and silver iodide in catalytic proximity to said silver behenate;

(d) a benzylidene leuco dye of the formula:

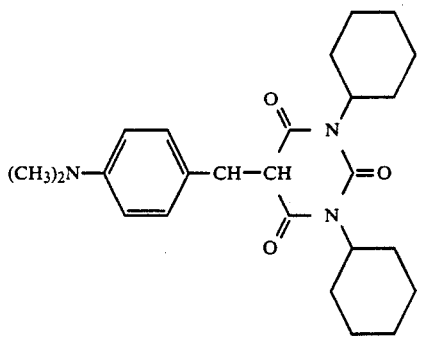

(e) a development accelerator selected from the group consisting of 2,4,6-Triphenyl-s-triazine and 2,4,6-Triphenoxy-s-triazine.

6. A photothermographic element comprising the photothermographic emulsion of claim 5 on a substrate.

* * * * *